US007032316B1

(12) United States Patent
Tseng

(10) Patent No.: US 7,032,316 B1
(45) Date of Patent: Apr. 25, 2006

(54) SCISSORS

(76) Inventor: Liang-Chuan Tseng, P.O. Box 90, Tainan City 70499 (TW)

( * ) Notice: Subject to any disclaimer, the term of this patent is extended or adjusted under 35 U.S.C. 154(b) by 0 days.

(21) Appl. No.: 11/017,904

(22) Filed: Dec. 22, 2004

(51) Int. Cl.
*B26B 13/08* (2006.01)

(52) U.S. Cl. ..... 30/226; 30/120; 30/230

(58) Field of Classification Search ..... 30/118, 30/120, 142, 145, 226, 227, 229, 230, 254, 30/256; D8/5, 57, 58
See application file for complete search history.

(56) References Cited

U.S. PATENT DOCUMENTS 69,605 A * 10/1867 Althouse ..... 30/120
404,169 A * 5/1889 Clark ..... 30/146
606,123 A * 6/1898 Coates ..... 30/120
1,207,476 A * 12/1916 Bergstrom ..... 30/142
1,374,819 A * 4/1921 Byer ..... 30/226
2,737,718 A * 3/1956 Maunu ..... 30/226
3,651,573 A * 3/1972 Kaplan ..... 30/226
3,978,584 A * 9/1976 Mayer ..... 30/256
D251,232 S * 3/1979 Yamamoto ..... D8/5
4,250,619 A * 2/1981 Buerkert et al. ..... 30/230
4,406,063 A * 9/1983 Zaitz ..... 30/230
4,584,770 A * 4/1986 Sabol ..... 30/267
5,758,422 A * 6/1998 Frank ..... 30/230

* cited by examiner

*Primary Examiner*—Hwei-Siu C. Payer

(57) ABSTRACT

A pair of scissors includes a left member, a right member, a main member and a combining member pivotally combined together. The scissors are formed with two different-shaped blades able to cut paper into different-patterned borderlines, convenient in use and able to lower expenses.

7 Claims, 7 Drawing Sheets

SCISSORS

BACKGROUND OF THE INVENTION

1. Field of the Invention

This invention relates to a pair of scissors, particularly to one including a left member, a right member and a main member pivotally combined together. The left, the right and the main member are respectively formed with different-shaped blades able to cut paper into different-patterned borderlines, convenient in use and able to lower expenses.

2. Description of the Prior Art

A pair of conventional scissors includes a left member and a right member pivotally combined together. The blades of the conventional scissors are mostly shaped straight, only able to cut paper into straight borderlines. To cut paper into different-patterned borderlines, it is necessary to purchase several pairs of scissors of different-shaped blades to be chosen for use, complicated in use and increasing expenses.

SUMMARY OF THE INVENTION

The objective of the invention is to offer a pair of scissors able to cut paper into two different-patterned borderlines, convenient in use and lowering expenses.

The scissors in the preset invention includes a left member, a right member, a main member and a combining member pivotally combined together. The left member is bored with a pivotal hole in the center, having one end bored with an insert hole and the other end formed with a blade. The right member positioned to the right side of the left member is bored with a pivotal hole in the center, having one end bored with an insert hole and the other end formed with a blade. The main member positioned between the left and the right member is bored with a pivotal hole in the center and an insert hole in one end. The main member has the opposite sides of the other end respectively formed with different-shaped blades respectively having the same shape as the blade of the left and the right member. The combining member is inserted in the pivotal holes of the left, the right member and the main member to pivotally combine them together.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
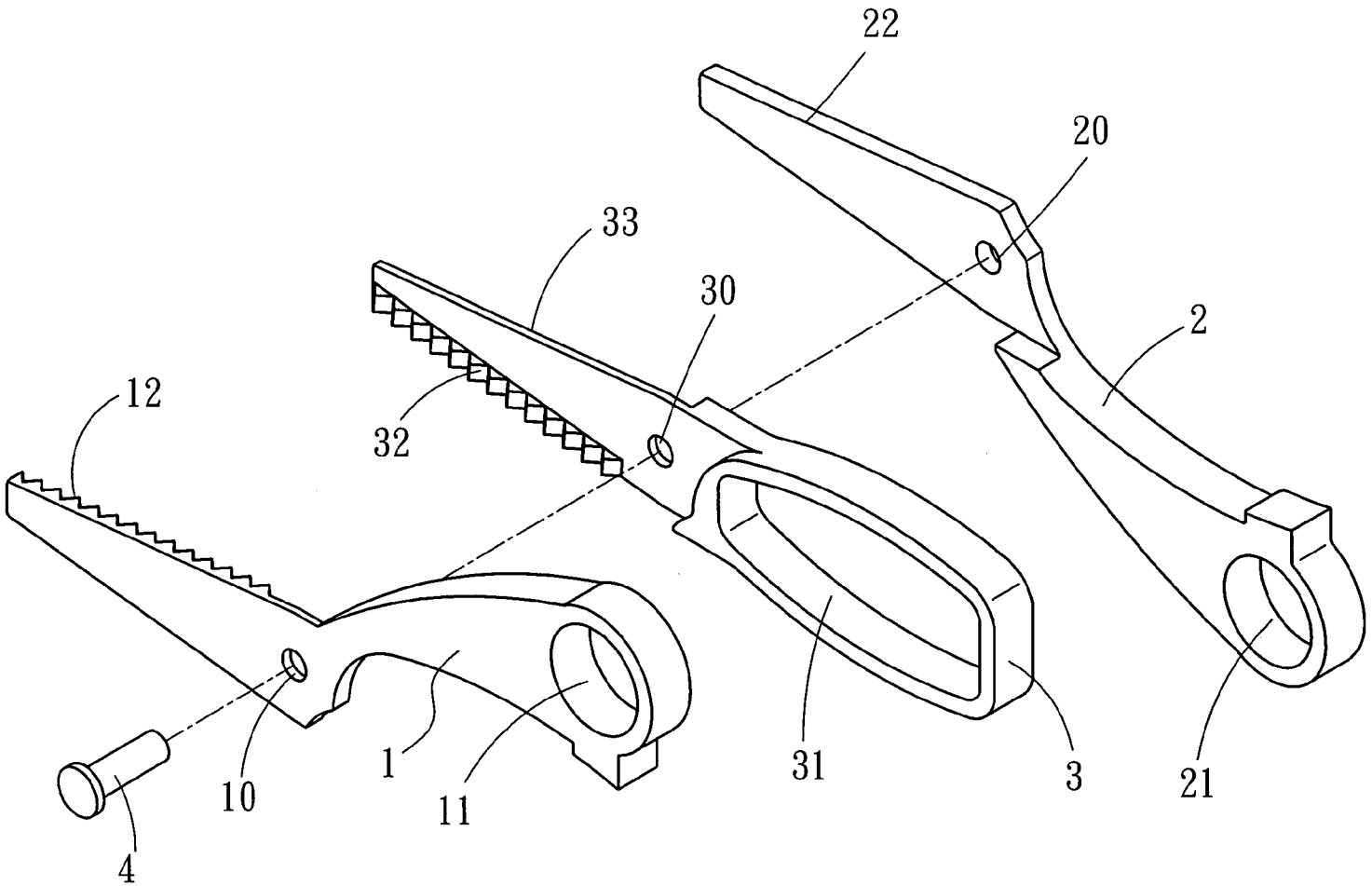
FIG. 1 is an exploded perspective view of a first preferred embodiment of a pair of scissors in the present invention.

A first preferred embodiment of a pair of scissors in the present invention, as shown in FIG. 1, includes a left member 1, a right member 2, a main member 3 and a combining member 4 pivotally combined together.

The left member 1 is bored with a pivotal hole 10 in the center, having one end bored with an insert hole 11 and the other end formed with a serrated blade 12.

The right member 2 to be positioned to the right side of the left member 1 is bored with a pivotal hole 20 in the center, having one end bored with an insert hole 21 and the other end formed with a straight blade 22.

The main member 3 positioned between the left and the right member 1, 2 is bored with a pivotal hole 30 in the center, having one end bored with an insert hole 31. The main member 3 further has the opposite sides of the other end respectively formed with a serrated blade 32 and a straight blade 33 respectively matching with the serrated blade 12 of the left member 1 and the straight blade 22 of the right member 2.

The combining member 4 is inserted in the pivotal holes 10, 20, 30 of the left, the right and the main member 1, 2, 3 to pivotally combine them together.

Figure 2:
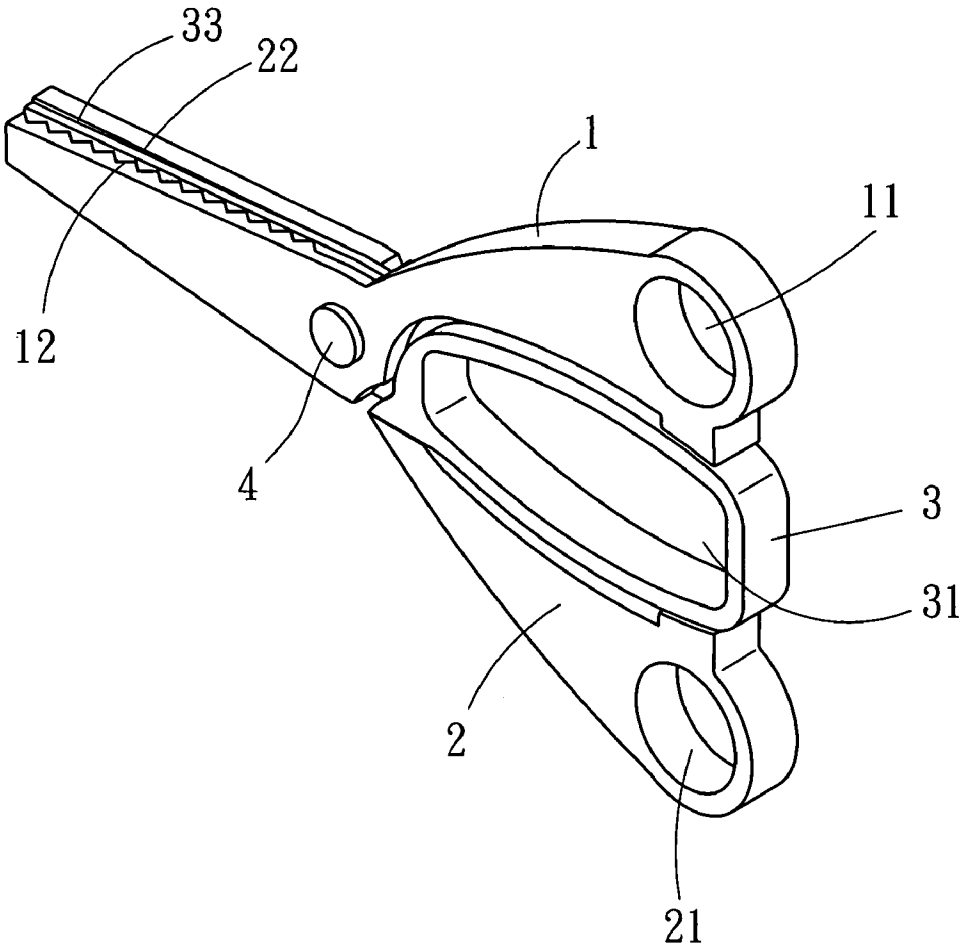
FIG. 2 is a perspective view of the first preferred embodiment of the scissors in the present invention.

In assembling, as shown in FIGS. 1 and 2, firstly, the left member 1 is closely positioned at the left side of the main member 3, letting the pivotal hole 10 of the left member 1 aligned to the pivotal hole 30 of the main member 3 and their serrated blade 12, 32 engaged with each other. Next, the right member 2 is closely positioned at the right side of the main member 3, letting the pivotal hole 20 of the right member 2 aligned to the pivotal hole 30 of the main member 3 and their straight blades 22, 33 closely contact with each other. Subsequently, the combining member 4 is inserted in the pivotal holes 10, 20, 30 to pivotally combine the left, the right and the main member 1, 2, 3 together to finish assembly of the scissors.

After assembly, the insertion hole of the main member 3 is located between the insertion hole of the loft member 1 and the insertion hole of the right member 2. One side of the insertion hole of the right member 2 is able to resist against a right side of the insertion hole of the main member 3; and one side of the insertion hole of the left member 1 is able to resist against the left side of the insertion hole of the main member 3.

Figure 3:
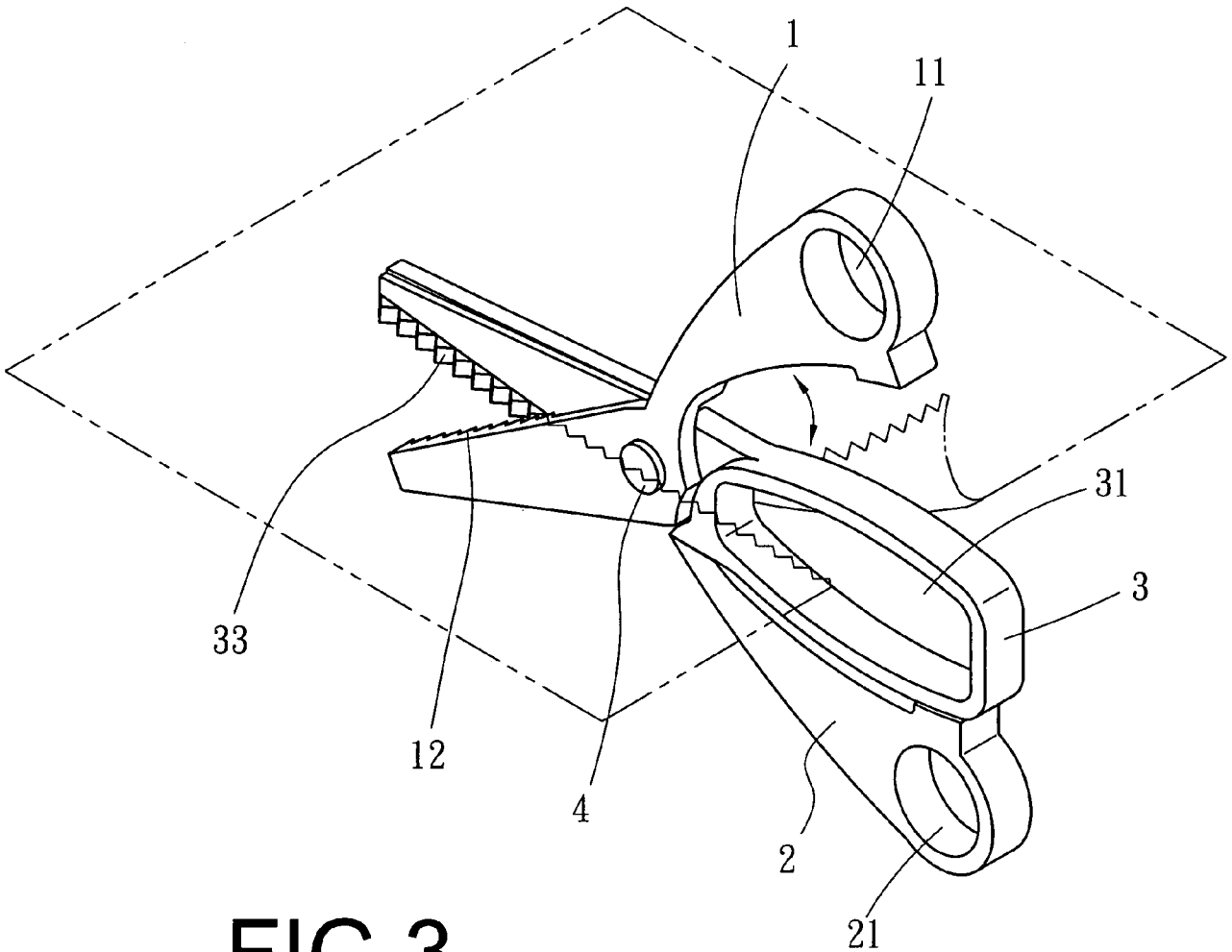
FIG. 3 is perspective view of the first preferred embodiment of the scissors used for cutting paper into serrated borderlines in the present invention.

To cut paper into serrated bored lines, as shown in FIG. 3, simply insert the thumb in the inserting hole 11 of the left member 1 and the other fingers in the inserting hole 31 of the main member 3 and then expand the area of the hand between the thumb and the index finger to have the serrated blades 12, 32 of the left and the main member 1, 3 stretched open relatively. Subsequently, the paper to be cut is positioned in the opening between the serrated blades 12, 32 of the left and the main member 1, 3 to be cut into serrated bored lines by opening and closing of the area of between the thumb and the index finger and with combining member 4 acting as a pivot.

Figure 4:
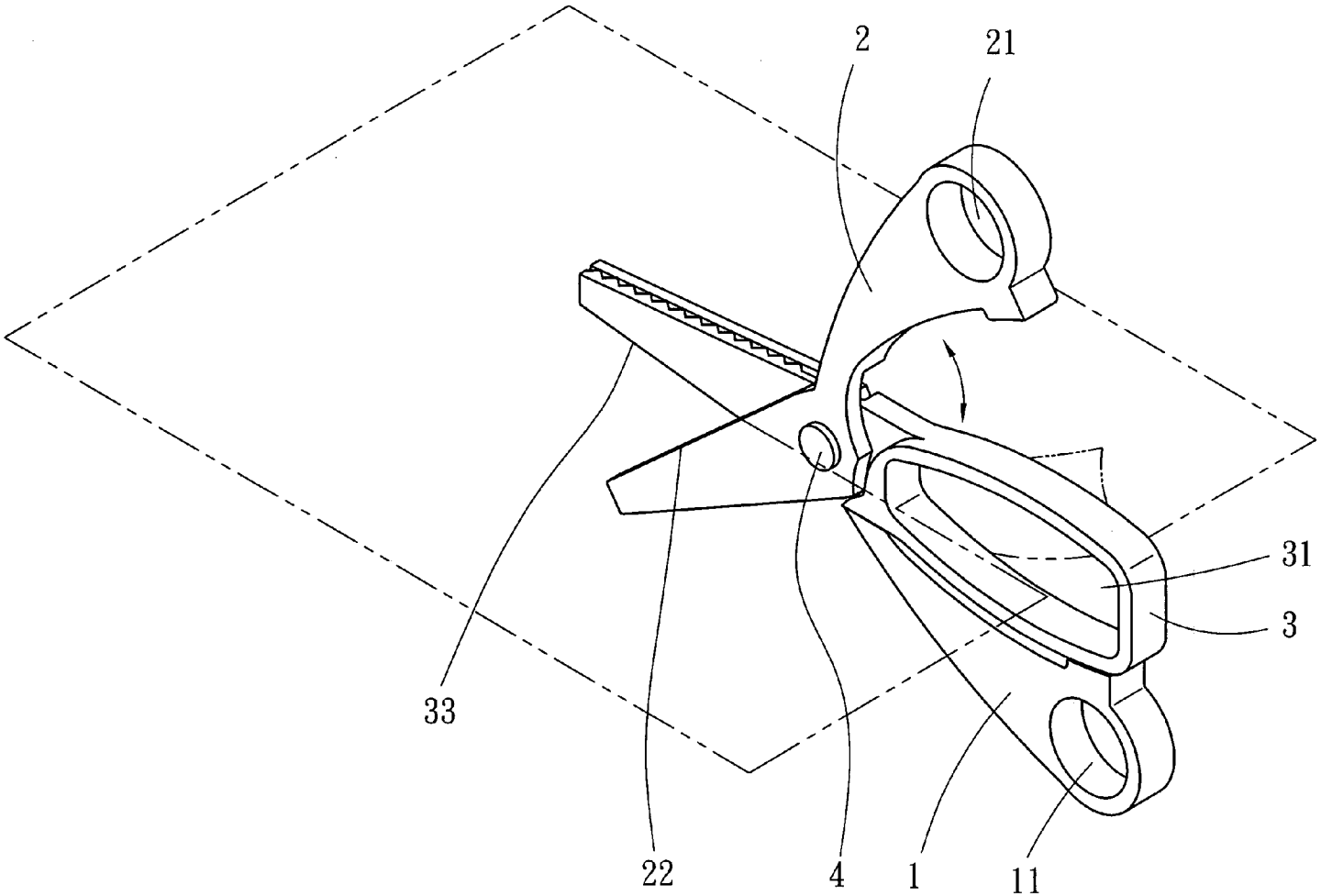
FIG. 4 is a perspective view of the first preferred embodiment of the scissors used for cutting paper into straight borderlines in the present invention.

To cut paper into straight border lines, as shown in FIG. 4, the scissors is first turned over to let the inserting hole 21 of the right member 2 face upward. Next, insert the thumb in the inserting hole 21 of the right member 2 and the other fingers in the inserting hole 31 of the main member 3 and then expand the area of the hand between the thumb and the index finger to have the straight blades 22, 33 of the right and the main member 2, 3 stretched open relatively. Thus, by the opening and closing of the area between the thumb and the index finger and with the combining member 4 acting as a pivot, the paper positioned in the opening between the straight blade edges 22 and 33 can be cut into straight border lines.

Figure 5:
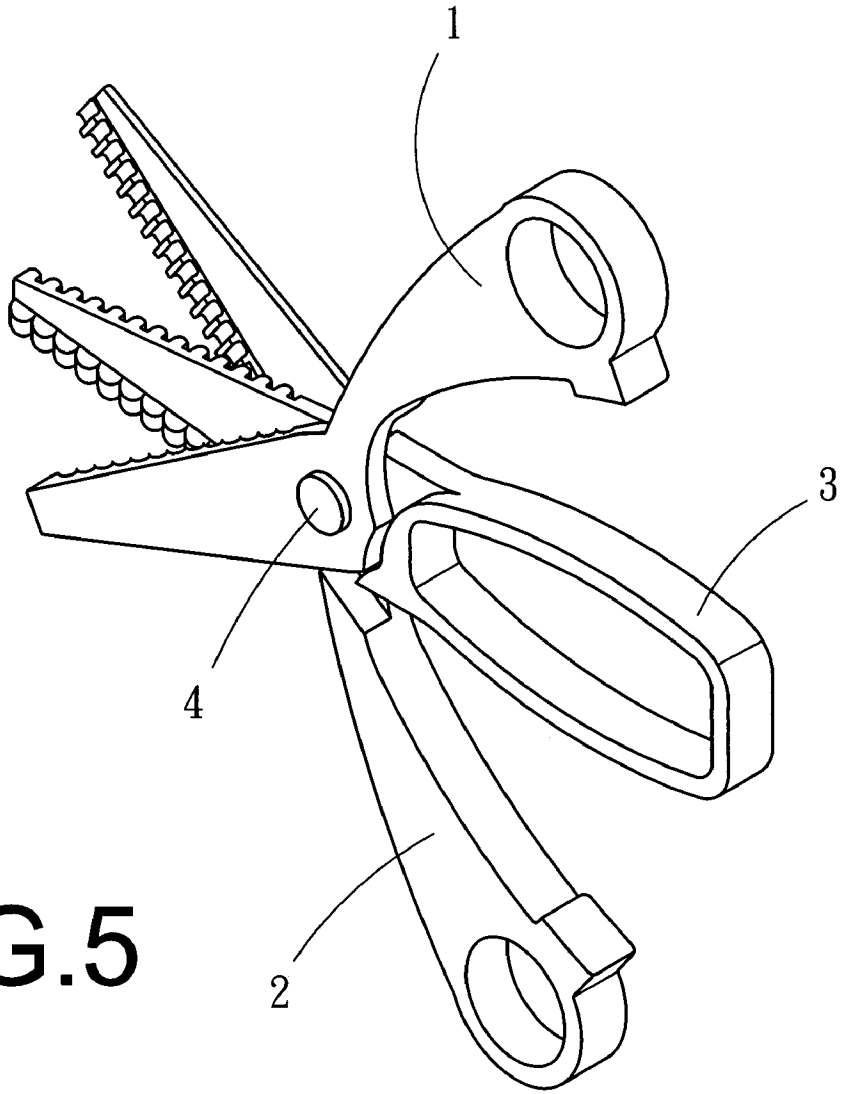
FIG. 5 is a perspective view of a second preferred embodiment of a pair of scissors in the present invention.
Figure 6:
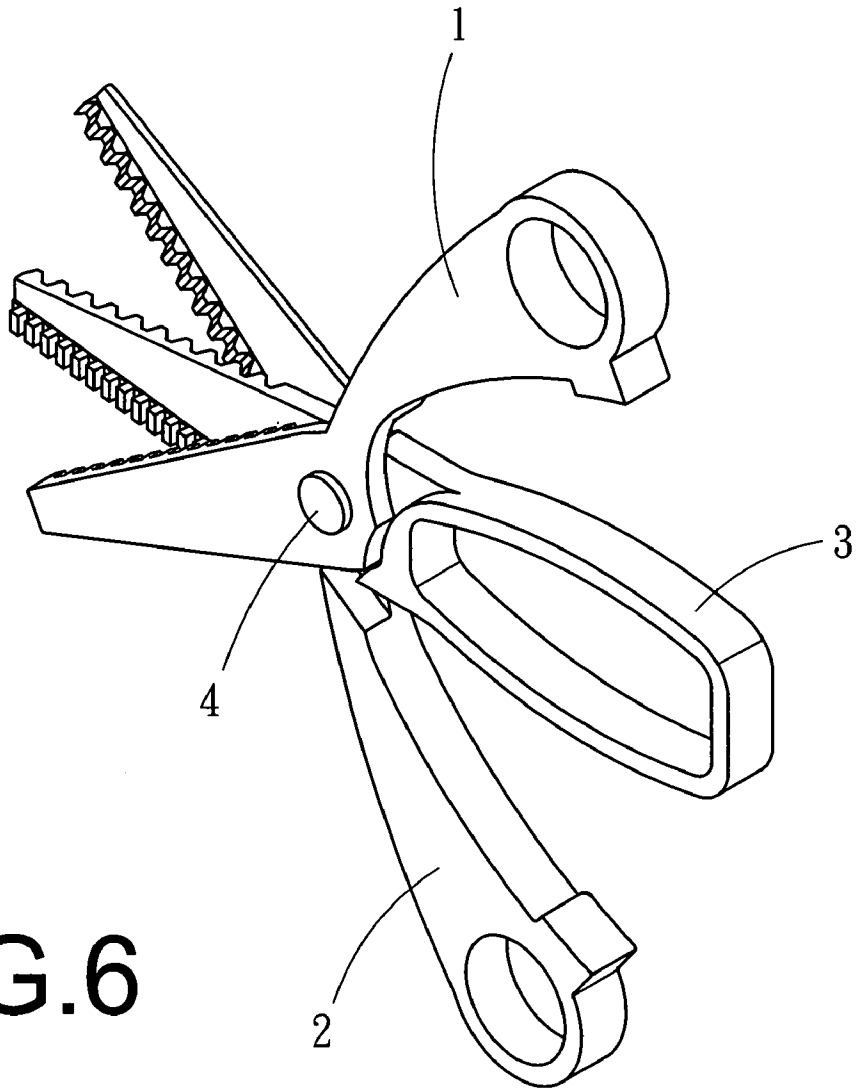
FIG. 6 is a perspective view of a third preferred embodiment of a pair of scissors in the present invention; and, FIG. 7 is a perspective view of a fourth preferred embodiment of a pair of scissors in the present invention.
Figure 7:
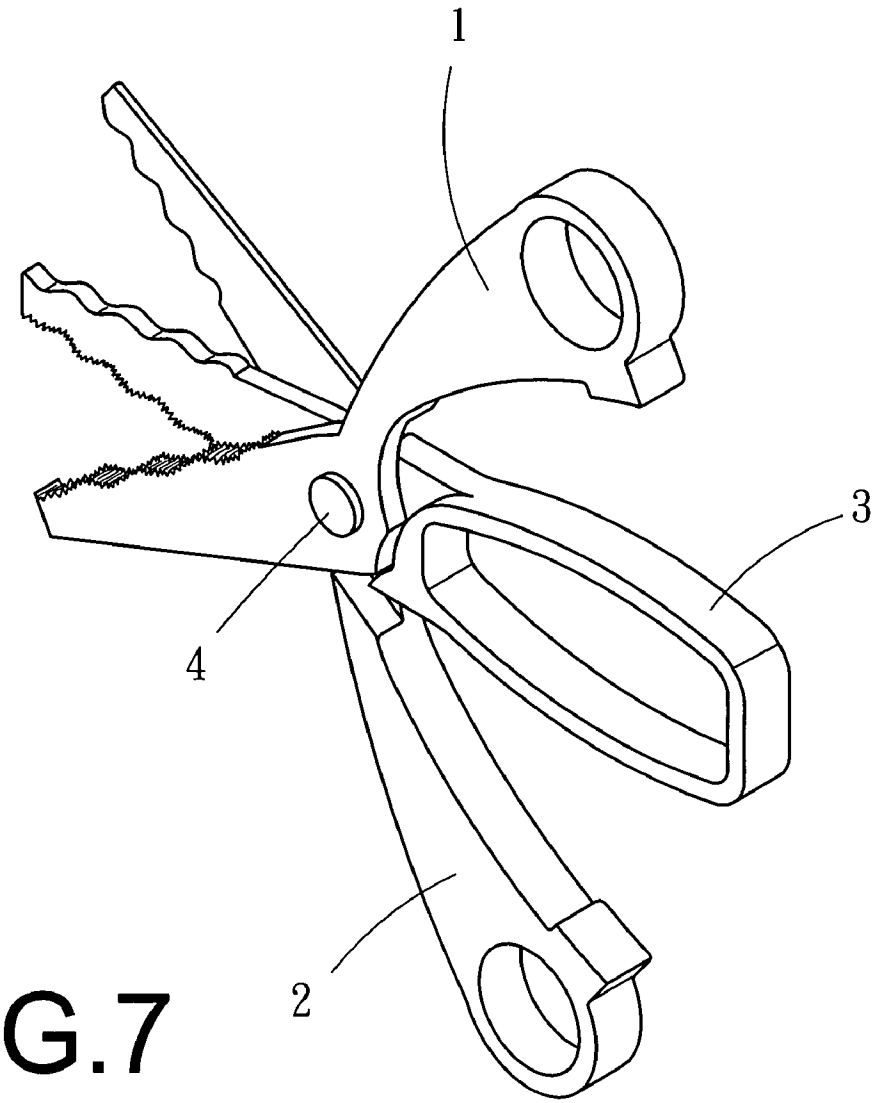

In addition, the blade edge 12, 22, 33 of the left, the right and the main member 1, 2, 3 of the scissors of this invention can be designed into different patterns to be optionally combined for use, as shown in FIGS. 5, 6 and 7, convenient in use and able to lower expenses.

As can be understood from the above description, this invention has the following advantages.

1. One pair of scissors of this invention can cut paper into two different-patterned borderlines, convenient in use.

2. It is unnecessary to purchase several pairs of scissors with different-patterned blades for use, able to lower expenses.

While the preferred embodiments of the invention have been described above, it will be recognized and understood that various modifications may be made therein and the appended claims are intended to cover all such modifications that may fall with the spirit and scope of the invention.

What is claimed is:

1. A pair of scissors comprising:

a left member bored with a pivotal hole in the center thereof, said left member having one end bored with an inserting hole and the other end formed with a blade edge;

a right member bored with a pivotal hole in the center thereof, said right member having one end bored with an inserting hole and the other end formed with a blade;

a main member positioned between said left member and said right member, said main member being bored with a pivotal hole in the center thereof, said main member having one end bored with an inserting hole, said main member having one side of the other end formed with a blade edge having the same shape as said blade edge of said left member, said main member having the other side of said other end formed with a blade having the same shape as said blade of said right member; and, a combining member inserted in said pivotal holes of said left, said right and said main member to pivotally combine them together;

wherein after assembly, the insertion hole of the main member is located between the insertion hole of the left member and the insertion hole of the right member; and one side of the insertion hole of the right member is able to resist against a right side of the insertion hole of the main member; and one side of the insertion hole of the left member is able to resist against the left side of the insertion hole of the main member.

2. The scissors as claimed in claim 1, wherein said blade edge of said left member and said blade edge of the one side of said main member are of a same serrated shape corresponding to each other.

3. The scissors as claimed in claim 1, wherein said blade of said right member and said blade of the other side of said main member are of a same straight shape corresponding to each other.

4. The scissors as claimed in claim 1, wherein said blade edge of said left member and said blade edge of the one side of said main member are of a same corrugated shape corresponding to each other.

5. The scissors as claimed in claim 1, wherein said blade of said right member and said blade of the other side of said main member are of a same alternate corrugated shape corresponding to each other.

6. The scissors as claimed in claim 1, wherein said blade edge of said left member and said blade edge of the one side of said main member have teeth; each teeth has a cross section of a trapezoid shape corresponding to one another.

7. The scissors as claimed in claim 1, wherein said blade of said right member and said blade of the other side of said main member are of a same shape like the Great Wall corresponding to each other.

* * * * *